United States Patent [19]

Humber

[11] Patent Number: 4,934,410

[45] Date of Patent: Jun. 19, 1990

[54] DUAL OUTLET WASHING MACHINE BOX

[75] Inventor: Jeffrey A. Humber, Memphis, Tenn.

[73] Assignee: Industrial Polychemical Service, Inc., Gardena, Calif.

[21] Appl. No.: 478,970

[22] Filed: Feb. 12, 1990

[51] Int. Cl.[5] ..... F16L 5/00

[52] U.S. Cl. ..... 137/360; 312/229

[58] Field of Search ..... 137/360; 312/229, 242; 220/3.2; 68/207

[56] References Cited

U.S. PATENT DOCUMENTS

| | | | |
|---|---|---|---|
| 2,952,271 | 9/1960 | Dick et al. | 137/360 |
| 3,834,781 | 9/1974 | Logsdon | 312/229 |
| 4,716,925 | 1/1988 | Prather | 137/360 |
| 4,865,072 | 9/1989 | Logsdon | 137/360 |

*Primary Examiner*—A. Michael Chambers

*Attorney, Agent, or Firm*—Walker & McKenzie

[57] ABSTRACT

A washing machine box for being mounted between two adjacent studs in a wall and for allowing first and second water supply lines and a drain line to be coupled to first and second water hoses and a drain hose, respectively, of a washing machine. The box includes a first side wall; a second side wall; and a base member having a first end attached to the first side wall and having a second end attached to the second side wall. The base member includes first drain attachment structure located adjacent the first end of the base member for allowing the drain line and the drain hose to be selectively attached thereto, second drain attachment structure located adjacent the second end of the base member for allowing the drain line and the drain hose to be selectively attached thereto, first water attachment structure located between the first and second drain attachment structure for allowing the first water supply line and the first water hose to be attached thereto, and second water attachment structure located between the first and second drain attachment structure and adjacent the first water attachment structure for allowing the second water supply line and the second water hose to be attached thereto.

20 Claims, 2 Drawing Sheets

DUAL OUTLET WASHING MACHINE BOX

BACKGROUND OF THE INVENTION

1. Field of the Invention: The present invention relates, in general, to boxes for use in attaching washing machine water and drain hoses to wall water outlet and drain lines.

2. Information Disclosure Statement: Open face boxes have been heretofore mounted in walls for allowing washing machine water and drain hoses to be attached to water outlet and drain lines.

One common type of such prior art boxes is disclosed by Dick et al, U.S. Pat. No. 2,952,271 and Logsdon, U.S. Pat. No. 3,834,781. This type of box typically includes a substantially rigid rectangular frame for being fixedly attached to two adjacent studs of the wall by way of ears and nails or the like. A first water valve is attached to the bottom of the frame adjacent one side wall thereof to allow a first water outlet line and a first washing machine water hose to be attached thereto. A second valve is attached to the bottom of the frame adjacent the other side wall thereof to allow a second water outlet line and a second washing machine water hose to be attached thereto. A coupling member is attached to the bottom of the frame between first and second water valves to allow a drain line and a washing machine drain hose to be attached thereto. The drain line includes a typical P-trap assembly. One problem with such prior art washing machine boxes is the requirement that one of the water outlet lines crosses over the P-trap assembly. Such a cross over is difficult and time consuming for the plumber and/or installer of the washing machine box, etc., and often prevents smooth installation of the wall board or the like.

Another type of such prior art boxes also includes a substantially rigid rectangular frame for being fixedly attached to two adjacent studs of the wall by way of ears and nails or the like with a first water valve attached to the bottom of the frame adjacent one side wall thereof to allow a first water outlet line and a first washing machine water hose to be attached thereto. However, the coupling member is attached to the bottom of the frame adjacent the other side wall and the second valve is attached to the bottom of the frame between the first water valve and the coupling member to allow a drain line and a washing machine drain hose to be attached to the frame adjacent one side wall thereof. One problem with such prior art washing machine boxes is the requirement that separate boxes be produced for installing the drain line and drain hose on the right and left of the water lines, etc. An improvement of this type box is disclosed in Prather, U.S. Pat. No. 4,716,925, owned by the assignee of the present invention. Prather, U.S. Pat. No. 4,716,925 discloses a washing machine box having a reversible base member with means for allowing a first water valve to be attached to one end thereof, means for allowing a drain line to be attached to the other end thereof, and means for allowing a second water valve to be attached between the first water valve and the drain line.

While the above boxes relate in general to the present invention, none disclose or suggest the present invention. More specifically, no known prior art discloses or suggests a washing machine box including, in general, a first side wall; a second side wall; and a base member having a first end attached to the first side wall and having a second end attached to the second side wall; the base means including first drain attachment means located adjacent the first end of the base means for allowing the drain line and the drain hose to be selectively attached thereto, second drain attachment means located adjacent the second end of the base means for allowing the drain line and the drain hose to be selectively attached thereto, first water attachment means located between the first and second drain attachment means for allowing the first water supply line and the first water hose to be attached thereto, and second water attachment means located between the first and second drain attachment means and adjacent the first water attachment means for allowing the second water supply line and the second water hose to be attached thereto.

SUMMARY OF THE INVENTION

The present invention is directed toward providing an improved box for use in attaching washing machine water hoses and drain hoses to wall water outlet and drain lines. The concept of the present invention is to provide a washing machine box which allows hot and cold water valves to be mounted in the center of the box regardless of whether the waste line is located left or right of the water supply lines.

The washing machine box of the present invention includes, in general, a first side wall; a second side wall; and a base member having a first end attached to the first side wall and having a second end attached to the second side wall; the base means including first drain attachment means located adjacent the first end of the base means for allowing the drain line and the drain hose to be selectively attached thereto, second drain attachment means located adjacent the second end of the base means for allowing the drain line and the drain hose to be selectively attached thereto, first water attachment means located between the first and second drain attachment means for allowing the first water supply line and the first water hose to be attached thereto, and second water attachment means located between the first and second drain attachment means and adjacent the first water attachment means for allowing the second water supply line and the second water hose to be attached thereto.

DESCRIPTION OF THE PREFERRED EMBODIMENT

Figure 8:
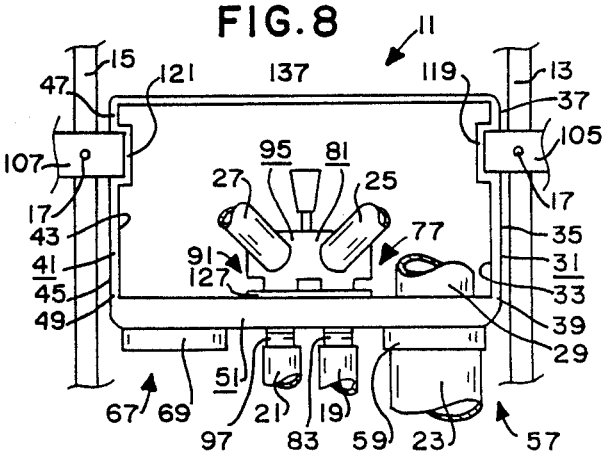
FIG. 8 is a front elevational view of the washing machine box of the present invention shown mounted on adjacent wall studs with water supply lines, water hoses, water valves, a drain line, and a drain hose attached thereto.

The washing machine box 11 of the present invention is designed to be fixedly mounted between a first stud 13 and an adjacent second stud 15 of a wall (see, in general, FIG. 8). More specifically, the box 11 is designed to allow nails 17 or the like to be used to attach the box 11 to the studs 13, 15 as will now be apparent to those skilled in the art. The box 11 allows a first water supply line 19 (e.g., a typical hot water supply line), a second water supply line 21 (e.g., a typical cold water supply line), and a drain line 23 to be coupled to first and second water hoses 25, 27 and a drain hose 29, respectively, of a washing machine (see, in general, FIG. 8) as will now be apparent to those skilled in the art.

The box 11 includes a first side wall 31. The first side wall 31 preferably has an interior side 33 an exterior side 35, an upper end 37, and a lower end 39.

The box 11 includes a second side wall 41. The second side wall 41 preferably has an interior side 43, an exterior side 45, an upper end 47, and a lower end 49.

The box 11 includes a base member 51 having a first end 53 attached to the first side wall 31 and having a second end 55 attached to the second side wall 41. The first end 53 of the base member 51 is preferably attached to the lower end 39 of the first side wall 31 and the second end 55 of the base member 51 is preferably attached to the lower end 49 of the second side wall 41.

The base member 51 includes first drain attachment mean 57 located adjacent the first end 53 of the base member 51 for allowing the drain line 23 and the drain hose 29 to be selectively attached thereto. The first drain attachment means 57 preferably includes a sleeve member 59 attached to and depending from the first end 53 of the base member 51 for receiving the drain line 23. Thus, the sleeve member 59 preferably has an aperture 61 sized to receive the drain line 23 with the drain hose 29 positioned within the drain line 23 as clearly shown in FIG. 6. The box 11 preferably includes a first cover means 63 for closing the aperture 61 of the sleeve member 59 as clearly shown in FIG. 5. Score means 65 are preferably provided about the first cover means 63 for allowing the first cover means 63 to be easily removed from the sleeve member 59. The score means 65 may consist of a groove extending at least part way around the aperture 61 between the aperture 61 and the first cover means 63 to allow the first cover means 63 to be easily removed from the base member 51 by merely hitting it with a hammer or the like as will now be apparent to those skilled in the art.

The base member 51 includes second drain attachment means 67 located adjacent the second end 55 of the base member 51 for allowing the drain line 23 and the drain hose 29 to be selectively attached thereto. The second drain attachment means 67 preferably includes a sleeve member 69 attached to and depending from the second end 55 of the base member 51 for receiving the drain line 23. Thus, the sleeve member 59 preferably has an aperture 71 sized to receive the drain line 23 with the drain hose 29 positioned within the drain line 23 as clearly shown in FIG. 5. The box 11 preferably includes a second cover means 73 for closing the aperture 71 of the sleeve member 69 as clearly shown in FIG. 6. Score means 75 are preferably provided for allowing the second cover means 73 to be easily removed from the sleeve member 69. The score means 75 may consist of a groove extending at least part way around the aperture 71 between the aperture 71 and the second cover means 73 to allow the second cover means 73 to be easily removed from the base member 51 by merely hitting it with a hammer or the like as will now be apparent to those skilled in the art.

The base means 51 includes first water attachment means 77 located between the first and second drain attachment means 57, 67 for allowing the first water supply line 19 and the first water hose 25 to be attached thereto. The first water attachment means 77 preferably has an aperture 79 extending through the base member 51 for receiving the first water supply line 19 and the first water hose 25. More specifically, a first water valve 81 is preferably attached to the base member 51 with the inlet end 83 thereof extending through the aperture 79 for being coupled to the first water supply line 19 and with the outlet end 85 thereof positioned above the base member 51 for being coupled to the first water hose 25 as clearly shown in FIGS. 5, 6 and 8. The box 11 preferably includes a third cover means 87 for closing the aperture 79 of the first water attachment means 77. Score means 89 are preferably provided for allowing the third cover means 87 to be easily removed from the base member 51. The score means 89 may consist of a groove extending at least part way around the aperture 79 to allow the third cover means 87 to be easily removed from the base member 51 by merely hitting it with a hammer or the like as will now be apparent to those skilled in the art.

The base means 51 includes second water attachment means 91 located between the first and second drain attachment means 57, 67 for allowing the second water supply line 21 and the second water hose 27 to be attached thereto. The second water attachment means 91 preferably has an aperture 93 extending through the base member 51 for receiving the second water supply line 21 and the second water hose 27. More specifically, a second water valve 95 is preferably attached to the base member 51 with the inlet end 97 thereof extending through the aperture 93 for being coupled to the second water supply line 21 and with the outlet end 99 thereof positioned above the base member 51 for being coupled to the second water hose 27 as clearly shown in FIGS. 5, 6 and 8. The box 11 preferably includes a fourth cover means 101 for closing the aperture 93 of the second water attachment means 91. Score means 103 are preferably provided for allowing the fourth cover means 101 to be easily removed from the base member 51. The score means 103 may consist of a groove extending at least part way around the aperture 93 to allow the fourth cover means 101 to be easily removed from the base member 51 by merely hitting it with a hammer or the like as will now be apparent to those skilled in the art.

The box 11 preferably includes a first ear member 105 for being secured to the first stud 13 and a second ear member 107 for being secured to the second stud 15. The first ear member 105 preferably has a first end 109 for being attached to the first stud 13 and a second end 111 for being attached to the interior side 33 of the first side wall 31. Likewise, the second ear member 107 preferably has a first end 113 for being attached to the second stud 15 and a second end 115 for being attached to the interior side 43 of the second side wall 41. The first ends 109, 113 of the ear members 105, 107 may have apertures or slots there through for allowing nails 17 or the like to be used to secure the ear members 105, 107 to the respective studs 13, 15 (see FIG. 8) as will now be apparent to those skilled in the art. The first end 109 of the first ear member 105 may be longer that the first end 113 of the second ear member 107. The second ends 111, 115 of the ear members 105, 107 are preferably bent at right angles to the respective first ends 109, 113 and provided with hooks 117 or the like to allow the ear members 105, 107 to be removably secured within slots or the like in the respective side wall 31, 41 as will now be apparent to those skilled in the art. More specifically, the box 11 preferably includes first loop means 119 attached to the interior side 33 of the first side wall 31 for removably receiving the second end 111 of the first ear member 105 and second loop means 121 attached to the interior side 43 of the second side wall 41 for removably receiving the second end 115 of the second ear member 107. Such removable ear members are disclosed in Prather, U.S. Pat. No. 4,716,925 and the Prather patent should be consulted for further details if desired. However, the loop means 119, 121 of the present invention are positioned on the interior sides 33, 43 of the respective side walls 31, 41 rather than being positioned on the exterior sides 35, 45 thereof as disclosed by the Prather patent to thereby allow the exterior sides 35, 45 to be positioned close to or adjacent the respective studs 13, 15 and thereby allow the interior width of the box 11 to be increased.

The first side wall 31 preferably has a recessed area 123 for receiving the first ear member 105 and the second side wall 41 preferably has a recessed area 125 for receiving the second ear member 107.

The box 11 preferably includes a raised platform member 127 positioned on the base member 51 between the first and second ends 53, 55 thereof with the first and second water attachment means 77, 91 located on the raised platform member 127.

The base member 51 preferably has a front edge or end 129 and a rear edge or end 131 extending between the first and second ends 53, 55 thereof. An upwardly angled or extending lip member 133 is preferably attached to the front edge 129 of the base member 51 and extends between the first and second side walls 31, 41.

The box 11 preferably includes a back member 135 joining the side walls 31, 41 and the base member 51 and a top member 137 joining the side walls 31, 41 and the back member 135.

A face plate or the like (not shown) may be provided for giving the box 11 a finished appearance, etc. Such a face plate is disclosed in Prather, U.S. Pat. No. 4,716,925 and the Prather patent should be consulted for further details if desired.

Figure 1:
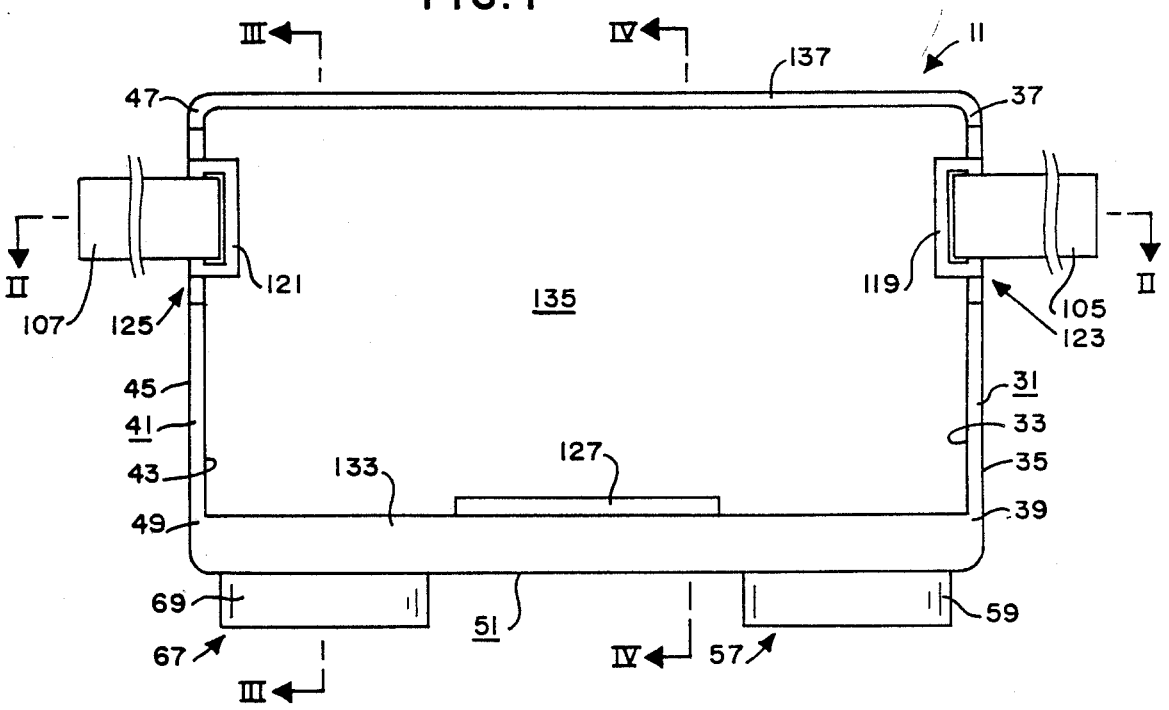
FIG. 1 is a front elevational view of the washing machine box of the present invention.
Figure 2:
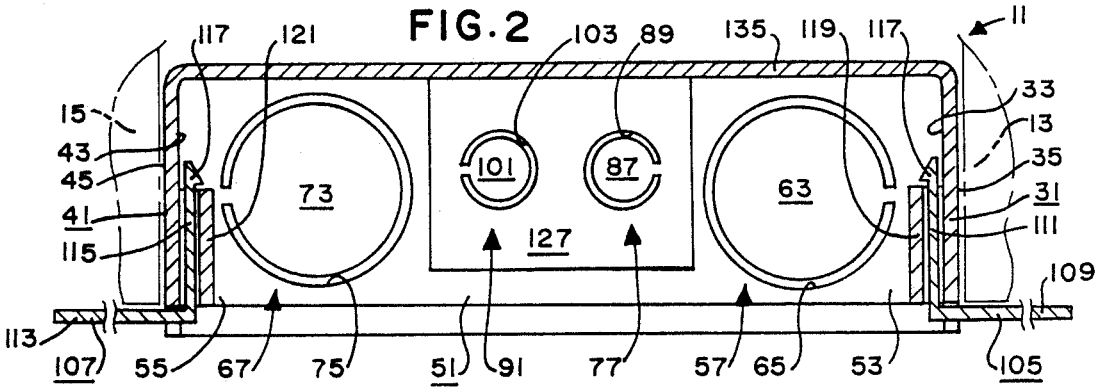
FIG. 2 is a sectional view substantially as taken on line II—II of FIG. 1 with adjacent studs shown in broken lines.
Figure 3:
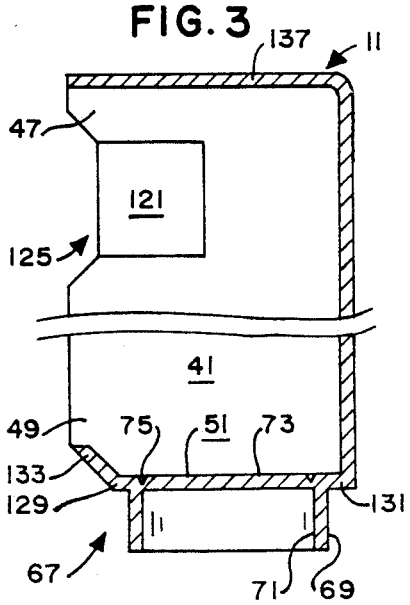
FIG. 3 is a sectional view substantially as taken on line III—III of FIG. 1.
Figure 4:
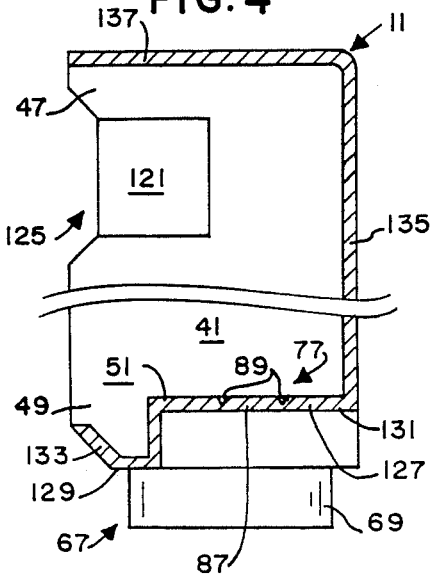
FIG. 4 is a sectional view substantially as taken on line IV—IV of FIG. 1.
Figure 5:
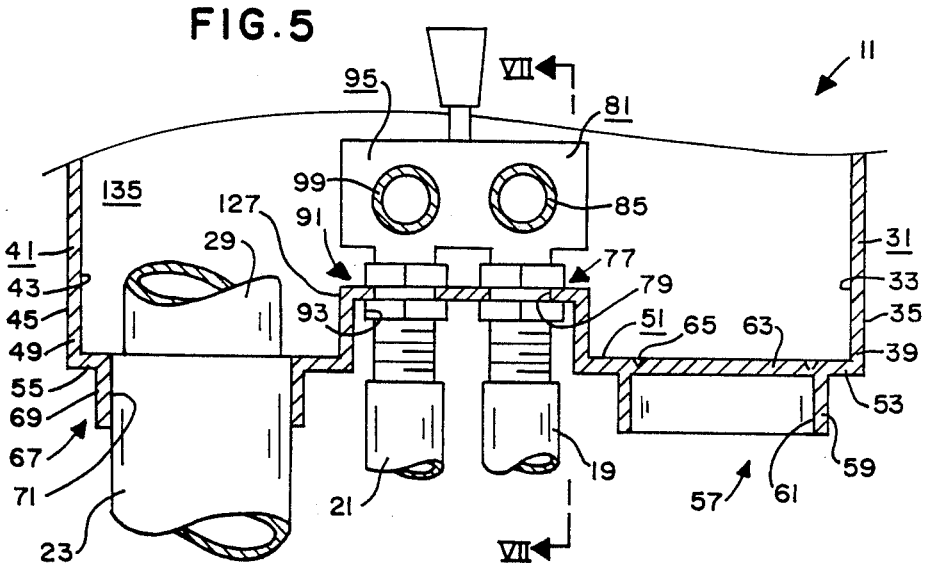
FIG. 5 is a sectional view of a portion of the box of the present invention coupled to water supply lines, a drain line, water hoses, a drain hose, and water valves.
Figure 6:
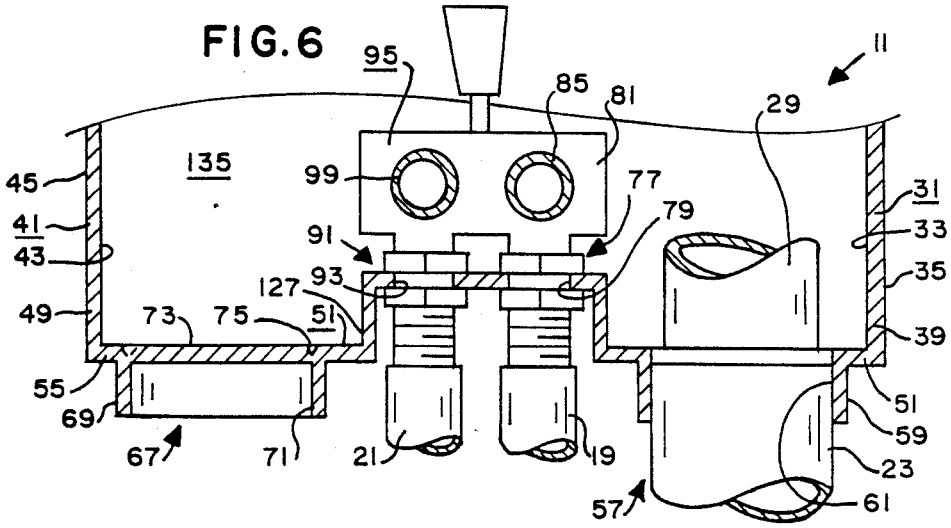
FIG. 6 is a sectional view similar to FIG. 5 but with the drain line and drain hose coupled to the opposite side of the box.
Figure 7:
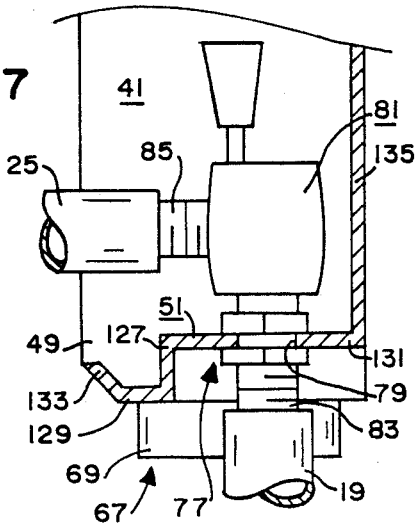
FIG. 7 is a sectional view substantially as taken on line VII—VII of FIG. 5.

The specific construction of the box member 11 may vary as will now be apparent to those skilled in the art. Preferably, the box 11 is molded or otherwise formed out of plastic or the like as a one-piece integral unit with the exception of the ear members 105, 107 and face plate which are preferably molded or otherwise formed separately out of plastic or the like for being removably attached to the side walls 31, 41 as will now be apparent to those skilled in the art. The water valves 91, 95 preferably consist of off-the-shelf units and may consist of two separate valves or of a single, integral unit with a single control handle for both valves as shown in FIGS. 5, 6 and 8 and as will now be apparent to those skilled in the art. The water valves 91, 95 can be pre-installed on the base member 51 at the factory and the plumber, etc., can buy the box 11 with the water valves 91, 95 pre-installed without deciding whether the drain line and drain hose will be on the left or right of the water lines, etc.—the plumber will merely knock-out the appropriate cover means 63, 73 when the box 11 is installed as will now be apparent to those skilled in the art.

Although the present invention has been described and illustrated with respect to a preferred embodiment and a preferred use therefor, it is not to be so limited since modifications and changes can be made therein which are within the full intended scope of the invention.

I claim:

1. A washing machine box for being mounted between two adjacent studs in a wall and for allowing first and second water supply lines and a drain line to be coupled to first and second water hoses and a drain hose, respectively, of a washing machine; said box comprising:

(a) a first side wall;

(b) a second side wall; and (c) a base member having a first end attached to said first side wall and having a second end attached to said second side wall; said base member including first drain attachment means located adjacent said first end of said base member for allowing said drain line and said drain hose to be selectively attached thereto; said base member including second drain attachment means located adjacent said second end of said base member for allowing said drain line and said drain hose to be selectively attached thereto; said base member including first water attachment means located between said first and second drain attachment means for allowing said first water supply line and said first water hose to be attached thereto; said base member including second water attachment means located between said first and second drain attachment means and adjacent said first water attachment means for allowing said second water supply line and said second water hose to be attached thereto.

2. The box of claim 1 in which said first side wall has an interior side and an exterior side; in which said second side wall has an interior side and an exterior side; and in which is included a first ear member for being secured to a first one of said pair of adjacent studs and a second ear member for being secured to a second one of said pair of adjacent studs; said first ear member having a first end for being attached to said first one of said pair of adjacent studs and having a second end for being attached to said interior side of said first side wall; said second ear member having a first end for being attached to said second one of said pair of adjacent studs and having a second end for being attached to said interior side of said second side wall.

3. The box of claim 2 in which is included first loop means attached to said interior side of said first side wall for removably receiving said second end of said first ear member; and in which is included second loop means attached to said interior side of said second side wall for removably receiving said second end of said second ear member.

4. The box of claim 3 in which said first side wall has a recessed area for receiving said first ear member; and in which said second side wall has a recessed area for receiving said second ear member.

5. The box of claim 1 in which said first drain attachment means includes a sleeve member attached to and depending from said first end of said base member for receiving said drain line.

6. The box of claim 5 in which said second drain attachment means includes a sleeve member attached to and depending from said second end of said base member for receiving said drain line.

7. The box of claim 6 in which said sleeve member of said first drain attachment means has an aperture for receiving said drain line; in which is included a first cover means for closing said aperture of said sleeve member of said first drain attachment means; said first cover means including score means for allowing said first cover means to be easily removed from said sleeve member; in which said sleeve member of said second drain attachment means has an aperture for receiving said drain line; in which is included a second cover means for closing said aperture of said sleeve member of said second drain attachment means; said second cover means including score means for allowing said second cover means to be easily removed from said sleeve member.

8. The box of claim 7 in which said first water attachment means of said base member has an aperture for receiving said first water hose.

9. The box of claim 8 in which said second water attachment means of said base member has an aperture for receiving said second water hose.

10. The box of claim 9 in which is included a third cover means for closing said aperture of said first water attachment means; said third cover means including score means for allowing said third cover means to be easily removed from said base member; and in which is included a forth cover means for closing said aperture of said second water attachment means; said fourth cover means including score means for allowing said third cover means to be easily removed from said base member.

11. The box of claim 10 in which base member includes a raised platform member positioned between said first and second ends thereof; said first and second water attachment means being located on said raised platform member of said base member.

12. The box of claim 11 in which said base member has a front end extending between said first and second ends thereof; and in which is included a lip member extending upward from said front edge of said base member and extending between said first and second side walls.

13. A washing machine box for being mounted between two adjacent studs in a wall and for allowing first and second water supply lines and a drain line to be coupled to first and second water hoses and a drain hose, respectively, of a washing machine; said box comprising:

(a) a first side wall; said first side wall having an interior side and an exterior side;

(b) a second side wall; second side wall having an interior side and an exterior side;

(c) a base member having a first end attached to said first side wall and having a second end attached to said second side wall; said base member including first drain attachment means located adjacent said first end of said base member for allowing said drain line and said drain hose to be selectively attached thereto; said base member including second drain attachment means located adjacent said second end of said base member for allowing said drain line and said drain hose to be selectively attached thereto; said base member including first water attachment means located between said first and second drain attachment means for allowing said first water supply line and said first water hose to be attached thereto; said base member including second water attachment means located between said first and second drain attachment means and adjacent said first water attachment means for allowing said second water supply line and said second water hose to be attached thereto;

(e) a first ear member for being secured to a first one of said pair of adjacent studs; said first ear member having a first end for being attached to said first one of said pair of adjacent studs and having a second end for being attached to said interior side of said first side wall; said first side wall having a recessed area for receiving said first ear member;

(f) a second ear member for being secured to a second one of said pair of adjacent studs; said second ear member having a first end for being attached to said second one of said pair of adjacent studs and having a second end for being attached to said interior side of said second side wall; said second side wall having a recessed area for receiving said second ear member;

(g) first loop means attached to said interior side of said first side wall for removably receiving said second end of said first ear member; and (h) second loop means attached to said interior side of said second side wall for removably receiving said second end of said second ear member.

14. The box of claim 13 in which said first drain attachment means includes a sleeve member attached to and depending from said first end of said base member for receiving said drain line.

15. The box of claim 14 in which said second drain attachment means includes a sleeve member attached to and depending from said second end of said base member for receiving said drain line.

16. The box of claim 15 in which said sleeve member of first drain attachment means has an aperture for receiving said drain line; in which is included a first cover means for closing said aperture of said sleeve member of said first drain attachment means; said first cover means including score means for allowing said first cover means to be easily removed from said sleeve member; in which said second drain attachment means has an aperture for receiving said drain line; and in which is included a second cover means for closing said aperture of said sleeve member of said second drain attachment means; said second cover means including score means for allowing said second cover means to be easily removed from said sleeve member.

17. The box of claim 16 in which said first water attachment means of said base member has an aperture for receiving said first water hose; and in which said second water attachment means of said base member has an aperture for receiving said second water hose.

18. The box of claim 17 in which is included a third cover means for closing said aperture of said first water attachment means; said third cover means including score means for allowing said third cover means to be easily removed from said base member; and in which is included a fourth cover means for closing said aperture of said second water attachment means; said fourth cover means including score means for allowing said third cover means to be easily removed from said base member.

19. The box of claim 13 in which base member includes a raised platform member positioned between said first and second ends thereof; said first and second water attachment means being located on said raised platform member of said base member.

20. The box of claim 19 in which said base member has a front end extending between said first and second ends thereof; and in which is included a lip member extending upward from said front edge of said base member and extending between said first and second side walls.

* * * * *